US011266292B2

(12) United States Patent
Boettger et al.

(10) Patent No.: US 11,266,292 B2
(45) Date of Patent: Mar. 8, 2022

(54) DEVICE FOR DISPENSING CLEANING AGENT

(71) Applicant: SANHUA AWECO Appliance Systems GmbH, Neukirch (DE)

(72) Inventors: Ulrich Boettger, Kressbronn (DE); Andreas Pleschinger, Schleedorf (AT); Erwin Wunn, Neukirch (DE); Zuo Wang, Immenstaad (DE)

(73) Assignee: SANHUA AWECO Appliance Systems GmbH, Neukirch (DE)

( * ) Notice: Subject to any disclaimer, the term of this patent is extended or adjusted under 35 U.S.C. 154(b) by 114 days.

(21) Appl. No.: 16/075,403

(22) PCT Filed: Feb. 3, 2017

(86) PCT No.: PCT/EP2017/052353
§ 371 (c)(1),
(2) Date: Aug. 3, 2018

(87) PCT Pub. No.: WO2017/134207
PCT Pub. Date: Aug. 10, 2017

(65) Prior Publication Data

US 2019/0038108 A1 Feb. 7, 2019

(30) Foreign Application Priority Data

Feb. 5, 2016 (DE) ..... 10 2016 102 086.9

(51) Int. Cl.
*A47L 15/44* (2006.01)
*A47L 15/42* (2006.01)

(52) U.S. Cl.
CPC ..... *A47L 15/4409* (2013.01); *A47L 15/4257* (2013.01)

(58) Field of Classification Search
CPC ..... A47L 15/4409; A47L 15/4418; A47L 15/4436; A47L 15/4445; A47L 15/44–4436; D06F 39/02–028
See application file for complete search history.

(56) References Cited

U.S. PATENT DOCUMENTS 5,086,952 A * 2/1992 Kryk ..... A47L 15/4436 222/565
2004/0200243 A1* 10/2004 Cheo ..... D06F 37/28 68/3 R (Continued)

FOREIGN PATENT DOCUMENTS

CN 101005787 A 7/2007
CN 101563015 A 10/2009

(Continued)

*Primary Examiner* — Michael E Barr
*Assistant Examiner* — Omair Chaudhri
(74) *Attorney, Agent, or Firm* — Breneman & Georges

(57) ABSTRACT

A device for dispensing detergent into a dishwasher, comprising a cover element for closing off or opening up at least one opening (2) of a reservoir (1) for storing the detergent, wherein the reservoir (1) has at least one base wall (8) arranged opposite the opening (2) and at least one side wall (7) oriented transversely to the base wall (8), is proposed, which device improves on the prior art. This is achieved according to the invention by virtue of the fact that at least one water conducting element (5, 9) is arranged for the conductance and/or guidance of water.

18 Claims, 7 Drawing Sheets

(56) References Cited

U.S. PATENT DOCUMENTS

Figure 1:
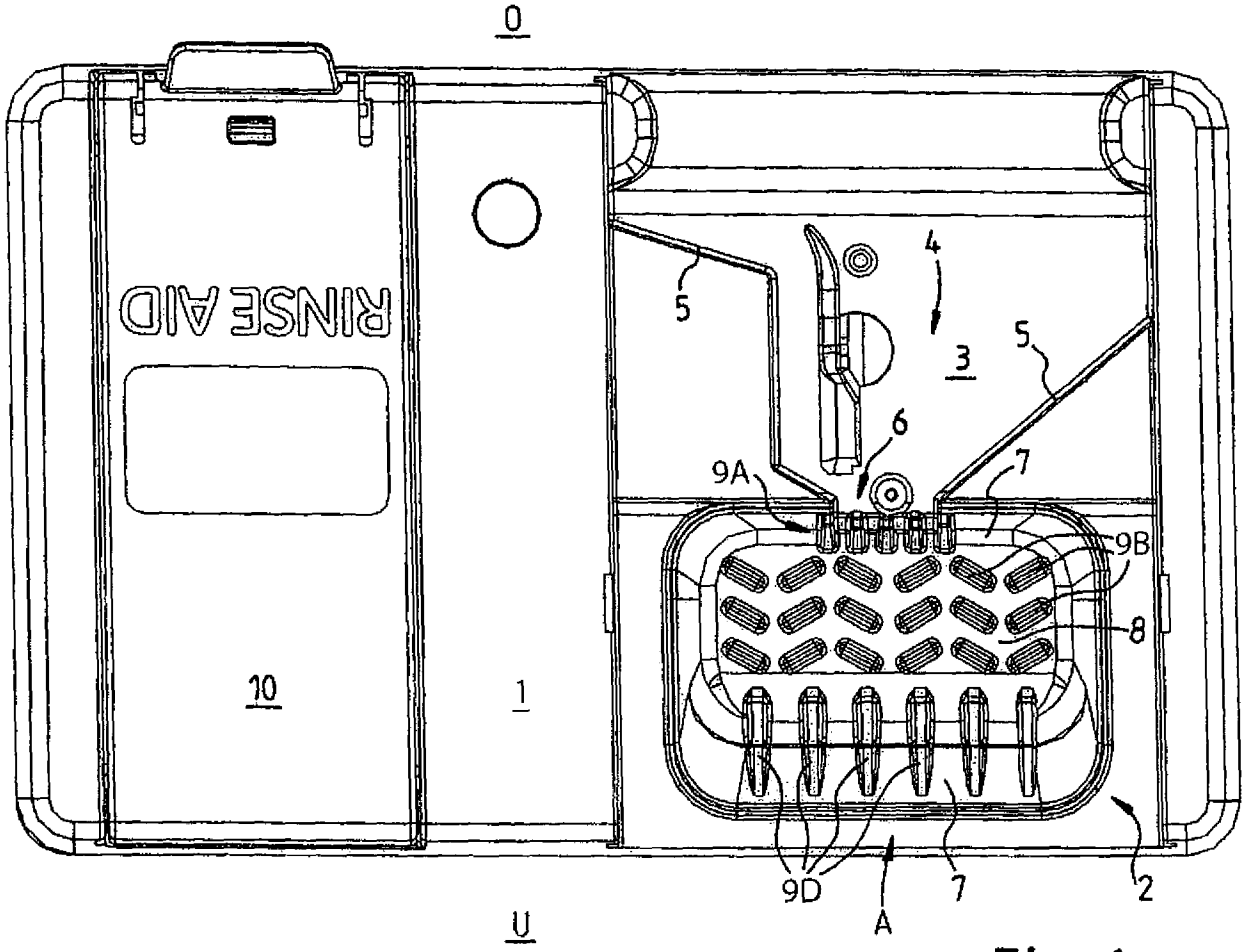

| | | | | |
|---|---|---|---|---|
| 2005/0045672 | A1 | 3/2005 | Marone | |
| 2014/0352364 | A1* | 12/2014 | Martinez Villarreal | D06F 39/022 68/17 R |
| 2016/0220094 | A1* | 8/2016 | Durham | A47L 15/4409 |

FOREIGN PATENT DOCUMENTS

| | | | |
|---|---|---|---|
| CN | 102159759 | A | 8/2011 |
| CN | 102666965 | A | 9/2012 |
| CN | 204379205 | U | 6/2015 |
| CN | 204734459 | U | 11/2015 |
| CN | 204765515 | U | 11/2015 |
| DE | 8516941 | U1 | 10/1986 |
| DE | G 85 16 941.2 | | 11/1986 |
| DE | 102 44 678 | A1 | 4/2004 |
| DE | 10 2005 025 391 | A1 | 12/2006 |
| DE | 102005025391 | A | 12/2006 |
| DE | 10 2006 055 345 | A1 | 5/2008 |
| EP | 0 780 087 | | 12/1996 |
| EP | 2240065 | B1 | 10/2010 |
| WO | WO 2009/083576 | A1 | 7/2009 |
| WO | WO 2017/134207 | A1 | 8/2017 |

* cited by examiner

DEVICE FOR DISPENSING CLEANING AGENT

The invention pertains to a device for dispensing detergent and more specifically a device for dispensing detergent into a dishwasher having a reservoir device or a storage compartment with a base wall, a side wall oriented to the base wall with spacer ribs or bosses on the base wall to allow water to dissolve the detergent from behind with a directing funnel and a water inlet in substantial alignment with the water spray arm to convey the water to the funnel and ribs or bosses on the base wall.

PRIOR ART

In dishwashers, dosing devices in which an intermediate chamber or dosing chamber is arranged downstream of a storage chamber for rinse aid have already been disclosed. A double-valve plunger herein actuates the valve function in the opening between storage chamber and dosing chamber, and in the outflow opening of the dosing chamber into the washing compartment of the dishwasher, in an oppositely working manner. This means that, upon a single energization of the electromagnetic valve provided for the actuation, the opening between storage chamber and dosing chamber is opened and the outflow opening of the dosing chamber is closed.

In the transition to the currentless state, the dosing chamber is subsequently closed off from the storage chamber and the outflow opening opened, so that the rinsing agent flows off into the washing compartment. This arrangement of the two chambers serves to predefine, with the aid of the predefined volume of the dosing chamber, a fixed dosing volume, wherein, upon each energization of the electromagnetic coil, rinse aid too is fed into the washing compartment of the dishwasher.

Dosing devices of this type are usually combined with a chamber or reservoir for the reception or storage of detergent. For the addition of the detergent into the washing process, this chamber or reservoir is opened with the aid of a lid or cover, which in the closed position is locked and is opened by spring pressure after unlocking. For cost-saving reasons, the unlocking takes place with the same electromagnetic coil with which the dosing of the rinse aid is conducted.

In order to observe the program sequence of the washing process also in terms of the addition of the appropriate detergent or rinsing agent, it is here necessary that, upon the first energization of the coil, only the lid or cover of the detergent chamber or reservoir is actuated, and only upon a following energization of the coil is the rinse aid dosing actuated. To this end, in commercially available dishwashers, a lever arrangement with a ratchet device, which effect a latching of the actuating lever for the rinse aid upon the first energization and a valve actuation for the rinsing agent only from the point of the second energization, is used. By opening of the dishwasher door, the ratchet mechanism is restored by means of gravity to the original state, so that a wash program can run afresh from the beginning. This is known, inter alia, also as a so-called "mechanical reset".

In addition, dosing devices for dishwashers, which dosing devices have, instead of a lid as the closing cover, a sliding cover which executes a linear movement relative to a plane parallel of the boundary wall of the liquid detergent container], yet at the end of the closing operation performs a lowering in order to seal the cover (cf. EP 0780 087 B1), are already known. These dosing devices, compared to a dosing device with a lid, avoid narrowing of the storage space in the dishwasher due to the motional space of the lid, which space has to be kept free.

A drawback with the last-named devices is however, inter alia, that a comparatively complex and fault-prone, in particular jamming or catching, guidance of the sliding cover, and a relatively large dosing device, are realized.

Furthermore, a dosing device which comprises a pivotable turning cover (cf. DE 102 44 678), which pivots about a rotational axis roughly parallel to the housing or to the door, wherein, here too, a lowering is provided at the end of the closing process for the sealing of the reservoir, is also known. It has been shown in practice however that inter alia, in long-term use, the turning cover is relatively easily impaired or damaged during operation. Also, the twisting for the actuation of the turning cover, in comparison to the above-stated sliding cover, is perceived by users as ergonomically and esthetically less pleasing.

In previous dosing devices, it is disadvantageous that, specifically in the use of detergent tablets, i.e. solid detergents in cuboid form, which in recent years have been used increasingly frequently, the detergent or "tablet" is not fully spent, so that, for the elimination of the dirt, too little detergent is dissolved in the water. Hence detergent is still fed in, in particular including in the rinse cycle, which is likewise disadvantageous.

OBJECT AND ADVANTAGES OF THE INVENTION

In contrast, the object of the invention is to propose a device for dispensing detergent, which device improves on the prior art.

Starting from a prior art of the type stated in the introduction, this object is achieved by virtue of a water inlet opening that is in substantial alignment with the spray arm to conduct water to a funnel shaped compartment to funnel the water in a flow path perpendicular and then parallel to a base wall to more quickly and efficiently remove all detergent from a detergent reservoir. Advantageous embodiments and refinements of the invention are possible by virtue of having additional water conducting elements or ribs on the side wall and base wall including having distancing ribs or distancing elements to distance the detergent away from the base wall to provide a cavity between the base wall and the detergent, having at least one side wall and/or base wall with at least one conducting and/or distancing element having the distancing element also configured as a water conducting element, providing a plurality of distancing or water conducting elements, having the water distancing and/or conducting elements configured as ribs, bosses or dams with open or closed channels or grooves, slots or having the conducting elements configured as a projection of the base wall or side wall having the side wall, base wall or distancing element form a closed water channel to the passage of water and having at least one device disposed on a door for a cleaning appliance.

Accordingly, a device according to the invention is distinguished by the fact that at least one water conducting element is arranged for the conductance and/or guidance of water preferably into and/or in the reservoir and, in particular, is conducted to the base wall of the reservoir.

With the aid of the invention, it is achieved that water, in particular of the spray arm(s) of the dishwasher, not only passes/flies through the opening in the reservoir directly to the base wall of the reservoir, but is trapped by an advantageous part or a collection area of the device and, by means of the water conducting element, is conducted/guided into the reservoir and/or in the reservoir, preferably along the side wall toward the base wall.

Hence not only can the water which passes/flies directly through the opening in the reservoir into the reservoir in order to dissolve/rinse out/wash out the detergent be used, but additionally also water, which, next to the reservoir or the opening, strikes/flies onto/flows onto the device can be channeled in an advantageous manner to the reservoir. Consequently, according to the invention, washout water is additionally generated/becomes usable, so that the detergent is better washed out/dissolved. Correspondingly, less easily soluble detergent can also be used, and/or shorter washout times or phases realized.

In this way, water, in particular spray water, spray arm water or service/cleaning water, is trapped or collected in an advantageous manner and, by means of the water conducting element according to the invention, conducted/guided to an advantageous site, so that the detergent, in particular a solid detergent or a detergent tablet or the like, is washed/rinsed out of the device according to the invention, out of the reservoir, and passes into the interior or cleaning compartment of the dishwasher. As a result, the detergent is fully washed out or dissolved and, by means of the advantageous pumping system, is guided or pumped, in particular sprayed, to the dishware via spray arms.

Preferably, the water conducting element is configured as a funnel and/or comprises two water conducting elements/structures arranged at an acute angle to each other, which act like a funnel or conduct water from a larger cross section to a smaller cross section or conduct it to an outlet.

Advantageously, a water inlet or opening or recess is arranged on the side wall of the reservoir, so that water (in particular which has been captured/collected or conducted according to the invention) is channeled in an advantageous manner to the reservoir, in particular the side wall of the reservoir.

Often the devices are arranged in the door, so that the operating/washout position is realized with closed door, i.e. the base wall is in this case arranged/oriented substantially vertically. Detergent is usually loaded with opened door, so that, in this loading position, the base wall is arranged at the bottom or substantially in horizontal orientation, and the side wall(s) is/are arranged laterally.

Preferably, this water inlet of the side wall of the reservoir, in the operating position or in the washout position of the device, is arranged on a top side or an upper side wall of the reservoir. Thus, in the operating or washout position or with closed door, the water inlet is arranged at the top or an, in the vertical direction, upper side wall, or this side wall comprises the water inlet, to which the water is channeled in an advantageous manner by means of the water conducting element.

In one particular refinement of the invention, the water conducting element is arranged on the side wall and/or base wall. It can hereby be achieved that the water channeled laterally to the reservoir does not drip into the cleaning chamber, but flows or is conducted on the side wall or along the wall or surface into the reservoir, preferably along the side wall through to the base wall, and, moreover, also along the base wall.

According to the invention, by means of the water conducting element, a flow path is almost completely defined or guided/fixed, wherein the flow path according to the invention is configured from the site of the impact against the surface of the device or from the site of the collection/trapping of the water (as far as possible without interruption) to preferably the base wall. Onto the base wall has been placed, in the loading position, the detergent or tablet/solid detergent, to which base wall this generally adheres/sticks. As a result of the water conducting element(s), the detergent, in particular tablet, is dissolved or washed out in an advantageous manner with a relatively large quantity of water.

Preferably, at least one distancing element is arranged for the at least partial distancing of the detergent from the wall, in particular base wall, so that in particular, at least in part, a cavity present between wall and detergent. It is hereby achieved that water flow/is conducted "behind" or "under" the detergent, in particular tablet, and any stuck-on detergent/tablet loosens/washes out in an advantageous manner.

Advantageously, the side wall and/or base wall comprises at least the water conducting element and/or the distancing element. For instance, at least the base wall and/or the, in the operating/washout position or with closed door, upper and lower side wall, i.e. at top and bottom on the side, respectively comprises a water conducting element and/or a broadly continuous water conducting element. From the top of the upper side wall, which side wall is arranged preferably at an acute angle/inclined to the horizontal plane, an advantageous feeding/channeling can hereby be realized and, at the bottom or the lower side wall, enables with the water conducting element/distancing element, if the detergent/tablet should fall down/slide down onto this side wall, that water washes under the detergent/tablet in an advantageous manner and thus washes it out/dissolves it.

Preferably, the distancing element is configured at least partially as a water conducting element, in particular on the "lower" side wall and/or the base wall.

Preferably, a plurality of water conducting elements (oriented substantially parallel to one another) and/or a plurality of distancing elements are provided, in particular a plurality of water conducting elements and/or distancing elements are configured at least partially as ribs and/or bosses and/or dams and/or elevations and/or (open or closed) channels and/or grooves and/or slots and/or depressions. The surface tension and/or capillary force of the water is hereby used in an advantageous manner, for example, for the conductance or adhesion.

Advantageously, the water conducting element is configured at least partially as a projection of the reservoir and/or of the side wall. Water which flows/is conducted to the reservoir broadly vertically from above can hereby, inter alia, be "captured" so to speak, and diverted in an advantageous manner, in particular be conducted into the reservoir or to/along the side wall.

Thus the side wall and/or base wall, and at least one or two distancing elements, as well as the detergent, forms at least partially a closed water channel for the passage of water. The detergent/tablet is hereby dissolved from below in an advantageous manner or the bond loosened.

ILLUSTRATIVE EMBODIMENT

An illustrative embodiment of the invention is represented in the drawing and is explained in greater detail below with reference to the schematic figures.

Figure 2:
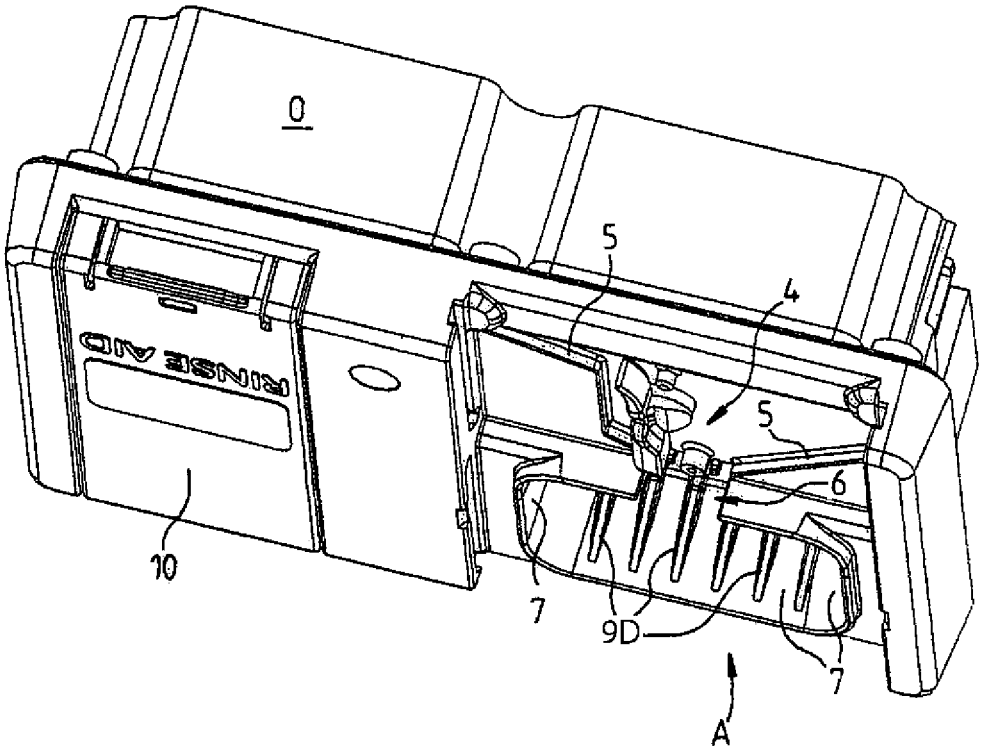
Figure 3:
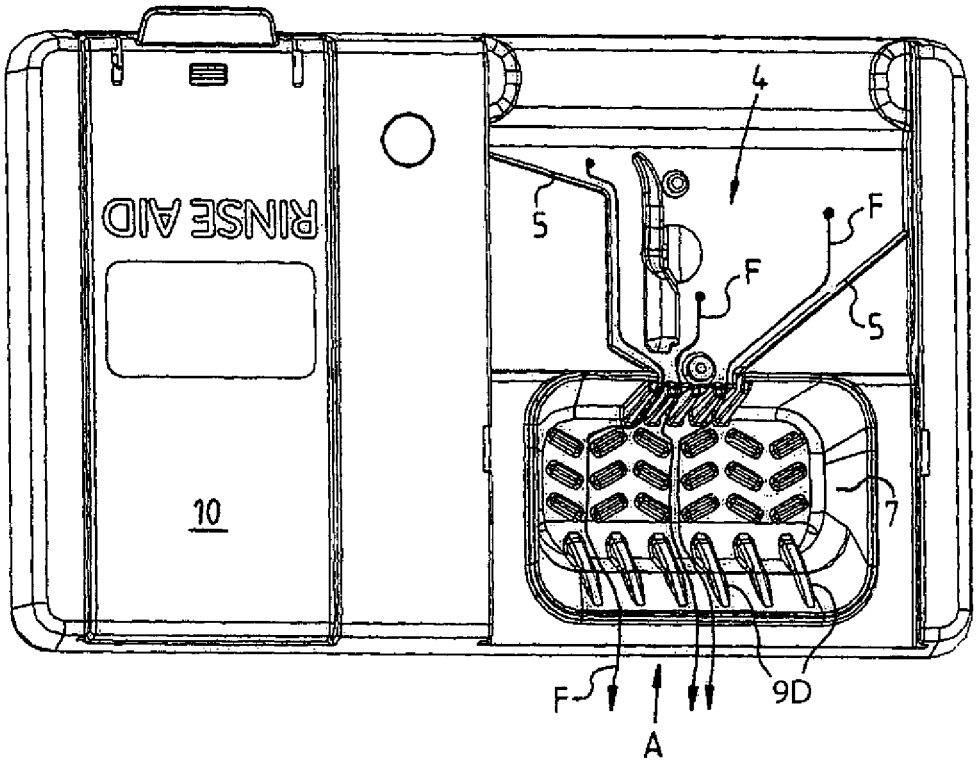
Figure 4:
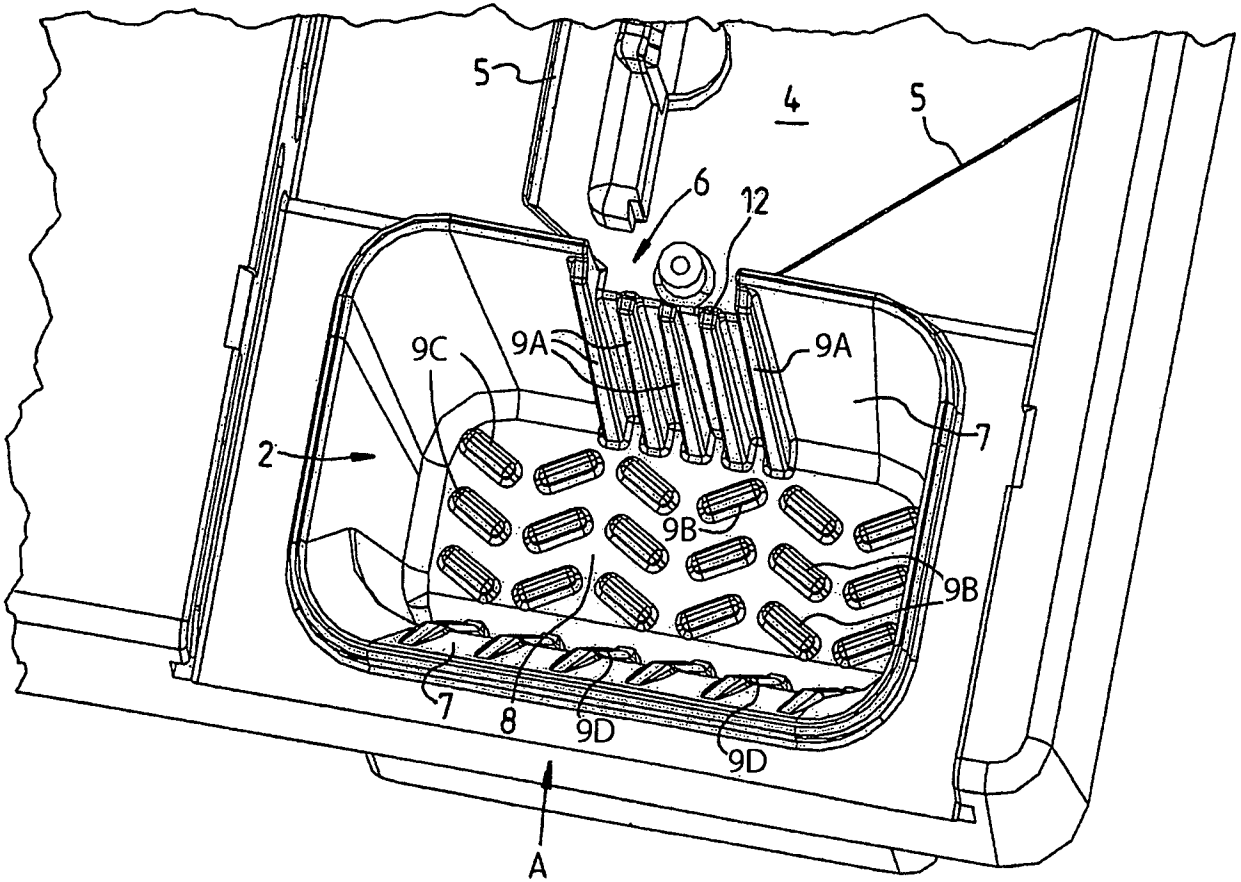
Figure 5:
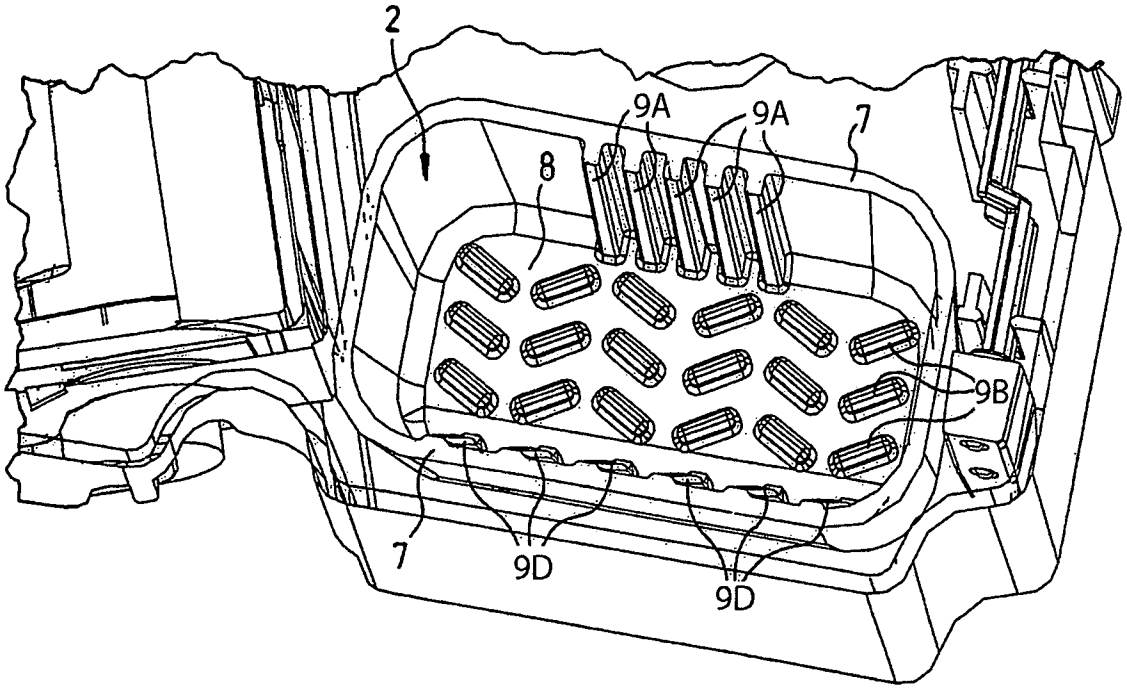
Figure 6:
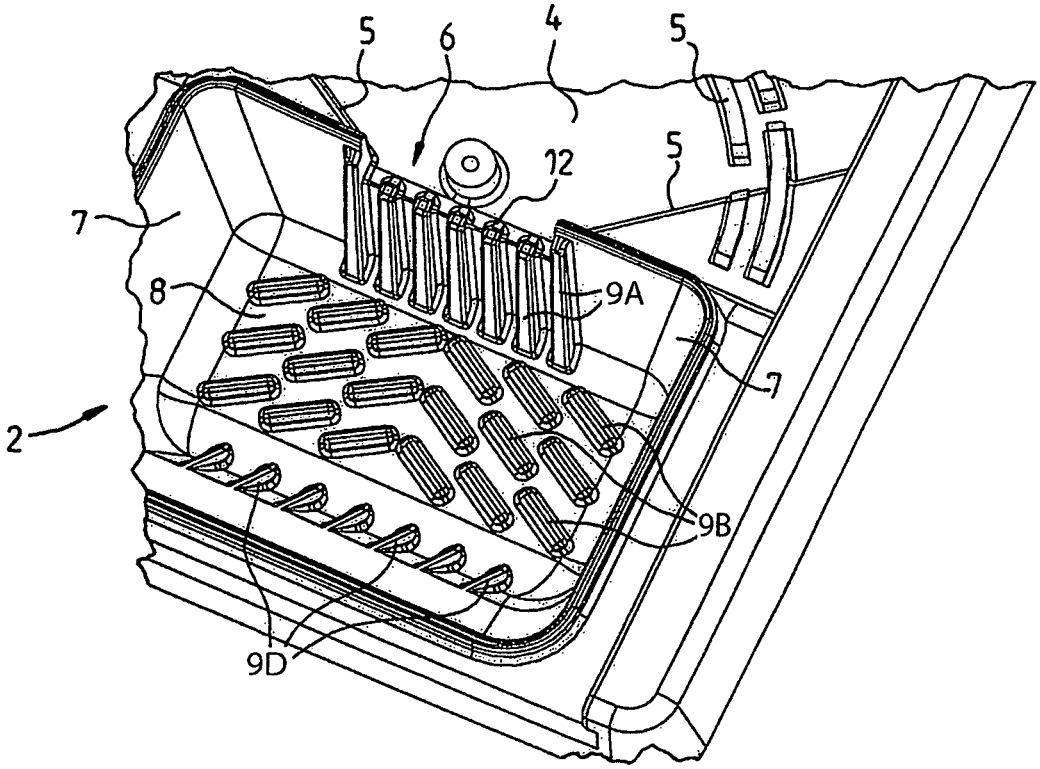
Figure 7:
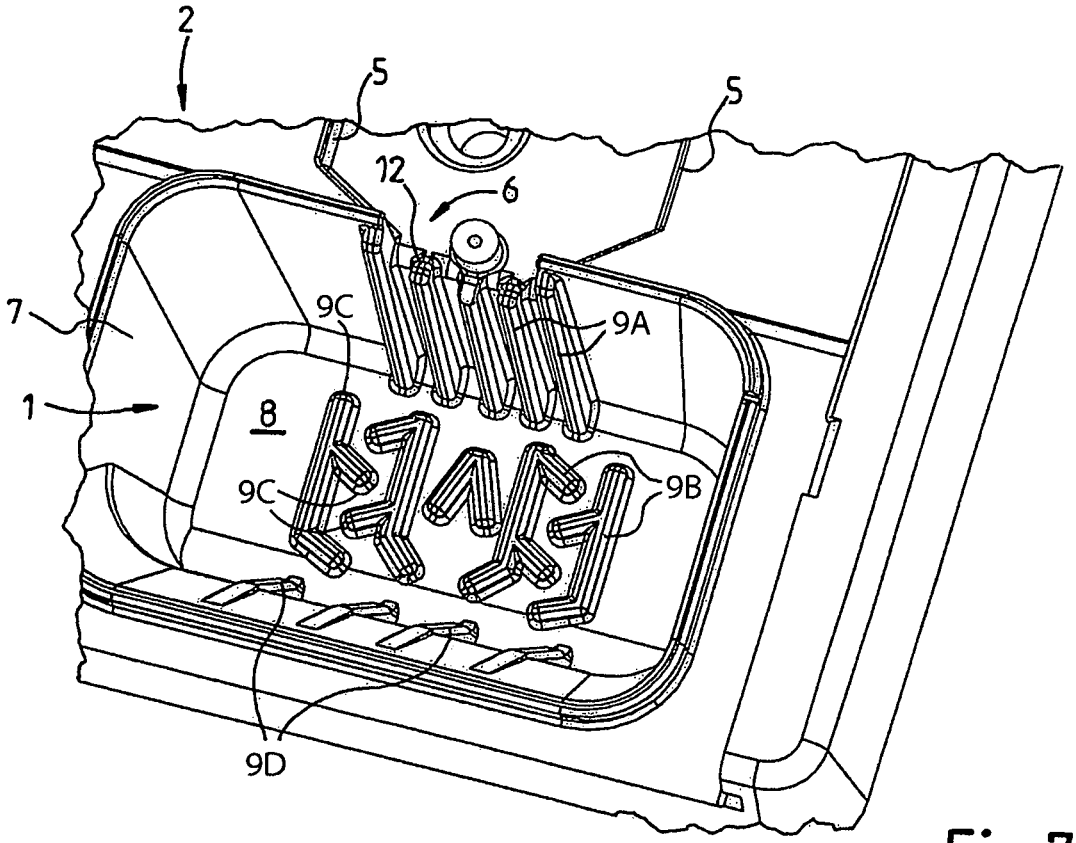

More specifically:

FIG. 1 shows in schematic representation a device according to the invention in front view (without cover/lid of a reservoir), FIG. 2 shows in schematic, perspective representation the device according to FIG. 1 viewed frontally from above, FIG. 3 shows in schematic, perspective representation the device according to FIG. 1 viewed laterally from the front, FIG. 4 shows in schematic, perspective representation a detail of a reservoir of the device according to FIG. 1 viewed frontally from below, FIG. 5 shows in schematic, perspective representation a section through the reservoir of the device according to FIG. 1 viewed frontally from below, FIG. 6 shows in schematic, perspective representation a detail of a second reservoir of a second device according to the invention, and FIG. 7 shows in schematic, perspective representation a detail of a third reservoir of a third device according to the invention.

In the figures is respectively represented a device according to the invention, wherein a reservoir device or storage compartment 1 is provided having a cavity for the reception of detergent. This detergent is fed in controlled dosage, during the cleaning phase of the dishwasher, into the cleaning chamber for the dishware. A cover (not represented in detail) is hereupon opened, so that the detergent can run out or be rinsed out of the reservoir opening 1 through outlet/outflow A FIGS. 1, 2 and 3. For instance, a latching device (not represented in detail), or a rotary detent, is actuated for this purpose, so that a tension spring or the like effects the opening movement of the cover.

The reservoir device or storage compartment 1 has a top O, bottom U (FIG. 1) with a base wall 8 and side walls 7. In the represented operating position or in the washout position of the device, on a top side or an upper side wall 7 of the reservoir opening 2 is provided a reservoir opening inlet 6 for water which flows/streams down from above or vertically along flow path F (FIG. 3).

In the operating position or in the washout position of the device, on the top side or over the upper side wall 7 of the reservoir opening 2 is provided a funnel 4, which is realized by means of a housing wall having two dams 5 or water conducting elements 5 or elevations 5. Water which sprays/flies from the spray arms to the device or into the water inlet 1A and additionally above the reservoir opening 2 onto the device, is hereby collected and channeled to the reservoir opening 2 in an advantageous manner.

In FIG. 4 specifically, it becomes clear that, on the rim of the reservoir opening 2 or the reservoir inlet 6 are provided projections 12 from ribs 9 of the side wall 7, which "capture" and redirect the downflowing water, are conducted along the upper side wall 7, which is inclined somewhat (at an acute angle) to the horizontal plane, by means of the water inlet bosses/ribs 9A or water conducting elements 9A according to the invention to the base wall 8.

The base wall 8, in turn, has space ribs bosses 9B or a profile/elevations, so that the water of the upper side wall 7 can flow "behind" a detergent tablet and can wash this out/dissolve this from "behind". As a result of the small bearing surface, i.e. "tips" 9C of the bosses 9B or ribs 9B of the base wall 8, a very rapid dissolution, even if the tablet is stuck on, is effected.

After this, the water will flow out of the reservoir opening 2 along the outlet ribs 9D of the lower side wall 7. Should a tablet, following detachment from the base wall 8, fall onto the lower side wall 7, which is slightly inclined relative to the horizontal plane, an "underflushing" or advantageous "outwashing" is here too realized by means of the ribs 9D.

The spacer bosses 9B or spacer ribs 9B of the base wall 8 are arranged or oriented advantageously, so that the water is advantageously distributed.

In FIG. 3, three separate flow paths of water are indicated by way of example, which water, according to the invention, is collected (point of impact), conducted/guided to/in the reservoir opening 2, and streams out (with dissolved detergent) (point of arrow).

Moreover, water which flows down along the door, i.e. water which flows down from above, and which flows to the device can also be collected into or from the tunnel 4 and conducted in an advantageous manner to the reservoir opening 2. Thus, according to the invention, water which strikes the wall/door outside the device is also collected, which means a marked increase in the quantity of water for dissolving/washing out the detergent/tablet.

Specifically a comparison of the structures or bosses/ribs 9A, 9B and 9D according to FIG. 4 with the structures or bosses/ribs 9A, 9B and 9D according to FIGS. 6 and 7, it becomes clear that the downflowing water is "captured" in an advantageous manner and conducted into the reservoir opening 2 and, specifically on the base wall 8, diverse structures or bosses/ribs 9B of different shape/formation, in particular branched and/or V-shaped structures or bosses/ribs 9B or the like, can be attained. An advantageously functional water navigation/guidance or "back-rinse" along the base wall 8 or between detergent tablet and wall 8 can hereby be realized.

In principle, an advantageous configuration of the guide ribs or of the dam 5, which are intended to conduct the water from the inside door and dispenser surface, respectively, into the detergent tray or the reservoir device 1 or storage compartment 1 can also have a larger radius, which can likewise have a favorable effect.

REFERENCE SYMBOL LIST

1 reservoir
2 reservoir opening
3 collection area/region
4 funnel
5 dam
6 inlet
7 side wall
8 base wall
9A water inlet bosses/ribs
9B spacer ribs or bosses
9C tips of bosses/ribs 9B
9D outlet ribs
10 rinse aid region
12 projection
A outlet/outflow
F flow path
O top
U bottom.

The invention claimed is:

1. A device for dispensing a detergent into a dishwasher, comprising a cover element (10) for closing off or opening up at least one opening (2) of a reservoir (1) for storing the detergent wherein the reservoir (1) has at least one base wall (8) in a plane parallel to and arranged opposite the at least one opening (2) and at least one side wall (7) oriented transversely to the base wall (8), and a plurality of non parallel rectilinear water conducting elements (9B) to provide for the conductance and guidance of water along a zig zag flow path (F) behind the detergent in the plane parallel to and opposite to the opening (2).

2. The device as claimed in claim 1 wherein the reservoir is a detergent storage compartment and has at least one parallel water conducting element (9A, 9D) disposed on the at least one side wall (7).

3. The device as claimed in claim 2 wherein the at least one parallel water conducting element 9D in the detergent storage compartment is one distancing element to provide at least a partial distancing of the detergent from the at least one side wall in the detergent storage compartment and wherein the plurality of non parallel rectilinear water conducting elements (9B) provides a cavity between the at least one base wall and the detergent.

4. The device as claimed in claim 2 wherein the plurality of non parallel rectilinear water conducting elements (9B) in the detergent storage compartment is disposed at angles to the at least one side wall and is at least one distancing element.

5. The device as claimed in claim 4 wherein the at least one parallel (9A, 9D) water conducting element is a plurality of water conducting elements and/or a plurality of distancing elements.

6. The device as claimed in claim 4 wherein the at least one parallel water conducting element and/or a distancing element (9A, 9D) is a rib and/or boss and/or dam and/or elevation and/or an open or closed channel and/or groove and/or slot and/or depression.

7. The device as claimed in claim 4 wherein the plurality of non parallel rectilinear water conducting elements is a projection from the detergent storage compartment and/or from the at least one side wall of the detergent storage compartment.

8. The device as claimed in claim 4 wherein the at least one side wall and/or the at least one base wall and the plurality of non parallel rectilinear conducting elements forms a partially closed water channel for the passage of water.

9. The device as claimed in claim 1 disposed in a door of a dishwasher.

10. A dispensing apparatus comprising:

(a) a recessed detergent reservoir having a closure to accommodate a detergent;

(b) a base wall (8) defining the bottom of the recessed detergent reservoir;

(c) a side wall (7) defining the depth of the recessed detergent reservoir between the closure and the base wall;

(d) a plurality of first base wall bosses or ribs (9A) in the recessed detergent reservoir extending substantially perpendicular to the base wall (8) in a first plane and connecting the base wall to the side wall and a water collection compartment to form a first water flow path between the base wall and the side wall;

(e) a plurality of second base wall bosses or ribs (9B) in the detergent reservoir extending angularly to each other and substantially perpendicular from the base wall in a second plane substantially perpendicular to the first plane to form a second zig zag flow path for water to dissolve a detergent or detergent tablet from behind the detergent or detergent tablet; and (f) the water collection compartment having a water collection side wall and a water conducting element or flow diverter terminating in a water inlet to the recessed detergent reservoir to collect and channel water to the recessed detergent reservoir.

11. The dispensing apparatus of claim 10 wherein said closure is a cover element enclosing the detergent reservoir.

12. The dispensing apparatus of claim 10 wherein the water collection compartment has a second water conducting element and a vertical drop.

13. The dispensing apparatus of claim 10 wherein the plurality of first base wall bosses or ribs disposed on the side wall are a part of the side wall.

14. The dispensing apparatus of claim 13 wherein the plurality of first base wall bosses or ribs are disposed between the water inlet and the recessed detergent reservoir.

15. A device for dispensing detergent comprising:

(a) a recessed reservoir for accommodating a detergent, said recessed reservoir having a water inlet opening and a water outlet opening;

(b) a base wall defining the bottom of the recessed reservoir;

(c) a side wall defining the depth of the recessed reservoir and connecting the base wall to the side wall;

(d) a plurality of rectilinear base wall ribs extending from the base wall in a zig zag pattern to distance the detergent from the base wall and form a plurality of channels between the detergent and the base wall to dissolve the detergent from behind;

(e) a plurality of side wall ribs connecting the side wall to the base wall; and (f) a water collection compartment (3) having a substantially vertical side wall disposed substantially parallel to the base wall and a funnel shaped element having a water conducting element having a first end and a second end horizontally displaced from the substantially vertical side wall in the water collection compartment and with a substantially vertical drop at the second end of the funnel shaped element.

16. The device of claim 15 wherein the plurality of side wall ribs are disposed in the water inlet opening.

17. The device of claim 15 wherein the plurality of side wall ribs are disposed in the water outlet opening.

18. The device of claim 15 wherein the plurality of rectilinear base wall ribs are disposed at angles to each other in a plane perpendicular to the base wall.

* * * * *